United States Patent [19]

Lewin et al.

[11] Patent Number: 4,593,744

[45] Date of Patent: Jun. 10, 1986

[54] SUPPORT ROLL IN A MACHINE FOR CONTINUOUS CASTING

[75] Inventors: Hans G. Lewin, Ratingen; Lothar Finck, Duisburg, both of Fed. Rep. of Germany

[73] Assignee: Mannesmann Aktiengesellschaft, Duesseldorf, Fed. Rep. of Germany

[21] Appl. No.: 602,943

[22] Filed: Apr. 23, 1984

[30] Foreign Application Priority Data

Apr. 26, 1983 [DE] Fed. Rep. of Germany ..... 3315376

[51] Int. Cl.[4] ..... B22D 11/128

[52] U.S. Cl. ..... 164/448; 29/116 R; 29/130; 72/201; 165/89

[58] Field of Search ..... 164/448, 442, 427, 428, 164/429; 72/201; 29/110, 116 R, 130, 123, 125; 165/89, 90

[56] References Cited

U.S. PATENT DOCUMENTS

| | | | |
|---|---|---|---|
| 344,403 | 6/1886 | Reed et al. | 29/110 |
| 3,262,218 | 7/1966 | Cymbalisty | 165/89 |
| 3,757,847 | 9/1973 | Sofinsky et al. | 164/428 |
| 4,074,750 | 2/1978 | Beghin | 164/448 |
| 4,086,957 | 5/1978 | Schrewe et al. | 164/448 |
| 4,090,553 | 5/1978 | Beghin | 164/448 |
| 4,442,883 | 4/1984 | Yamakami et al. | 164/442 |

FOREIGN PATENT DOCUMENTS

| | | | |
|---|---|---|---|
| 122656 | 9/1980 | Japan | 164/448 |
| 700278 | 12/1979 | U.S.S.R. | 164/448 |

*Primary Examiner*—Francis S. Husar
*Assistant Examiner*—Jerry Kearns
*Attorney, Agent, or Firm*—Ralf H. Siegemund

[57] ABSTRACT

A support roll is provided with a plurality of surface near axis parallel cooling ducts extending from a cylindrical manifold chamber into which coolant is fed through a stationary hollow rod having openings and carrying on one end a disk which remains stationary and provides variable rate of feeding into the ducts as the roll rotates such that the duct adjacent a surface portion of the roll in contact with the casting receives maximum coolant flow.

4 Claims, 2 Drawing Figures

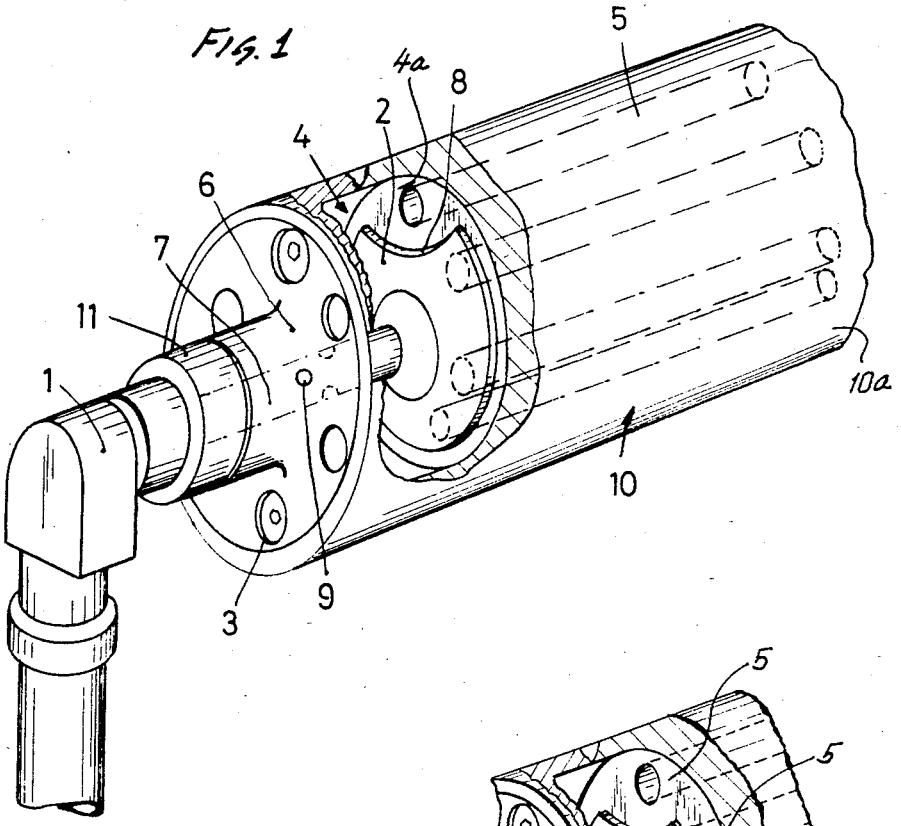
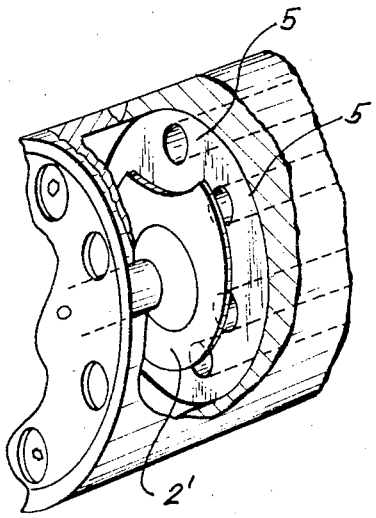
FIG. 2

SUPPORT ROLL IN A MACHINE FOR CONTINUOUS CASTING

BACKGROUND OF THE INVENTION

The present invention relates to a support roll for use in a machine for continuous casting, and more particularly the invention relates to such a roll, having internal ducts arranged close to the surface of the roll and extending in axis parallel relation, there being in addition feeding and discharge paths for the cooling medium running through the support journal for the roll.

Rolls of the type to which the invention pertains are, for example, shown in German Pat. No. 3,012,736. This patent proposes moreover to improve rolls or rollers of the type referred to above with regards to durability strength and wearability in that in each channel a particular element is arranged which extends over the length of the respective channel, and expands as the cooling medium in heated through the heat transfer process into the roll. This arrangement has the purpose of enhancing and increasing cooling of that portion of the roll which receives the maximum heat content.

DESCRIPTION OF THE INVENTION

It is an object of the present invention to provide a new and improved roll or roller to be used in a machine for continuous casting.

It is a particular object of the present invention to provide a new and improved roll for use in a machine for continuous casting which includes surface near parallely arranged cooling ducts communicating with a feed and discharge system through the journal pins of the roll.

It is a specific object of the present invention to improve specifically rolls of the type as per particular object but to provide a simplified construction particularly with an eye on facilitation of maintenance.

In accordance with the preferred embodiment of the present invention, a roll in accordance with the particular object is improved to provide a manifold cavity or chamber on the feed side of the roll from which the various cooling ducts extend and to include within that manifold chamber a shutter or cover element which selectively covers (fully or partially) and uncovers entrances to particular ducts. This cover element rotates relative to the roll, that is to say the cover element in fact remains stationary and does not follow the rotation of the roll. The manifold chamber is preferably of cylindrical configuration, and the ducts extend from one cylinder end thereof. Preferably the cover element is held by a rod-like carrier which penetrates the manifold and distribution system, and is in fact secured in the inlet duct of the journal pin at the particular feed end of the roll. The carrier rod is preferably of hollow configuration and, therefore, participates in the distribution system. The hollow rod is preferably provided with radial bores through which the cooling medium can enter the manifold and distribution chamber mentioned earlier. The cover element is preferably provided as a disk with a cutout permitting access to at least one cooling channel or duct while covering the others. Alternatively, the cover element may be provided with the plural cutouts, each covering an entrance to a cooling duct only partially at the most.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a perspective, partially cut open, view of a roll for continuous casting constructed and improved in accordance with the preferred embodiment of the present invention for practicing the best mode thereof; and FIG. 2 illustrates a modification still constituting an example for the preferred embodiment.

Proceeding now to the detailed description of the drawings, FIG. 1 illustrates a roll 10 being an element in the withdrawal path for a machine for continuous casting. The roll 10 is basically constructed as a solid cylindrical element traversed, however, near its surface 10*a* by a plurality of parallely oriented ducts or channels 5. These ducts 5 are arranged as a group concentrically around the axis of the roll and cylinder, and they extend parallel to each other as well as to the axis of that roll.

The cut-open portion in FIG. 1 illustrates that these ducts and channels 5 all terminate in or begin, if you will, in a base surface 4*a* of a cylindrical cavity or chamber 4. This chamber 4 constitutes a manifold and cooling medium distributing chamber. Reference numeral 11 refers to one of the two journal pins which extend from the axially ends respectively of the roll 10. This journal pin 11 is hollow and traversed by a feed tube or sleeve 1 through which water is supplied as cooling medium into the cooling system of roll 10, and here particularly of the manifold and distribution chamber 4. Details of this feed connection will be described shortly.

The chamber 4 includes in addition a disk 2 arranged basically adjadent to the particular chamber surface 4*a* in which the ducts 5 terminate. Therefore, this disk 2 covers the entrances to these ducts except that a cutout 8 is provided so that at least one duct has its entrance not covered by the disk 2. The disk 2 remains stationary so that upon rotation of the roll 5, one duct after another is open to the chamber 4 while the others are covered.

It should be mentioned in this regard that this covering of some of the cooling ducts is to be understood only in a general sense. It is not necessary to seal off these entrances, rather it is the intention of this system to realize a basically unbalanced or non-uniform cooling medium distribution system in which the cooling flow in one or a few ducts is increased or enhanced while the flow of cooling medium into the other ducts is reduced with progressively and periodically changing of the indentity of these ducts which receive enhanced and which receive impeded cooling flow.

FIG. 2 illustrates by way of example that the disk 2' may have a diameter which is chosen such that the openings for the ducts 5 are never completely closed while the cutout opens one of the ducts 5 completely. This then is in clear realization of the concept of merely imbalancing the coolant flow, but permitting still a substantial flow of coolant material through those ducts which are adjacent surface portions of the roll which at that instant do not engage the casting, but of course are still quite hot and receive, for example, thermal energy through radiation, particularly in those zones close to the zone of contact.

In order to make sure that the disk 2 (2') does in fact remain stationary, it is held in a cantilever fashion by a hollow carrier rod or bar 7 in that the disk 2 is affixed to one end of that bar. This bar or hollow rod 7 transverses the pin 11 and extends into the stationary feed structure 1 for the cooling medium. In fact it is affixed thereto.

The disk 2 has an orientation, i.e., the azimuthal angle of the cutout 8 is selected such that it frees the opening for that particular duct, which, as far as the duct system is concerned, is in any instant adjacent that surface portion of the roll 10 against which the casting or ingot to be moved abuts. In the particular illustrated version the orientation of this cutout 8 is selected so that the respective uppermost duct 5 receives enhanced and increased cooling flow. This means that the particular roll 10 is assumed to be situated in the lower track portion of a track and withdrawal path for the casting, and here particularly in the horizontal or near horizontal portion of such track moving the casting that has been veered already into the horizontal.

Basically the carrier rod 7 could be a solid and the cooling flow from the entrance facility 1 will then run around that rod. However, it is more practical, particularly with regard to the available cross-section for cooling flow, to provide this rod 7 in a hollow configuration so that it serves also as a feed tube for the cooling medium. Accordingly, this tubular carrier 7 is provided with radially outwardly oriented bores and openings 9, opening from the interior of the hollow carrier 7 towards the chamber 4.

For purposes of inspection and cleaning the interior of the roll, its front end may be provided with openings such as 3 following a distribution pattern equal to or similar to that of the channels 5. During operation these openings 3 of course are sealingly closed by means of suitable screws and bolts and copper sealing. Only for purpose of maintenance, these openings are opened and the ducts in channels 5 can then be cleaned.

The invention has a number of significant advantages, and here particularly with regard to the controlled water feeding or, better, the control of the rate of feeding through the simple expedient of a suitably contoured cover disk. This in fact permitted a drastic increase in the number of cooling channels penetrating the roll without reducing for a given rate of water flow the through flow of water through those of the ducts which have to be cooled the most.

The contour and configuration of this cover disk makes possible an appropriate relative selection of water through-put through the various ducts dependent upon the role they play in any instant in the overall cooling process. Of course the cooling ducts should be arranged as close as possible, i.e., as structurally permissible to the outer zone and outer surface of the roll as well as very cloe together. This in fact offers significant advantage toward stability with regard to overall bending of the roll. The zone of primary active thermal extension can in fact be reduced to a very high degree without weakening the overall cross-section. This feature is directly instrumental with regard to the support and cooling function of the roll, which in turn reduces the possibility that the withdrawn casting exhibits internal rupture. Moreover, avoiding of bending of the roll in the stated manner avoids any need for a central support of the roll to avoid bending and sagging. Finally the simple mode of cleaning means that the water used for cooling does not have to be particularly processed because the cooling ducts can be cleaned indeed in a very simple fashion.

The invention is not limited to the embodiments described above, but all changes and modifications thereof not constituting departures from the spirit and scope of the invention are intended to be included.

We claim:

1. In a roll for continuous casting having a plurality of axially extending and parallely oriented, surface-near cooling ducts, the roll further having journal pins through which cooling coolant feeding and discharge is provided, there being a cylindrical manifold coolant distribution chamber near one axial end of the roll and having a base surface from which said cooling ducts extend, there being duct entrances accordingly; the improvement comprising:

a stationary cover element positioned in said manifold chamber constructed to permit unrestricted access to at least one of said cooling duct entrances while partially or completely covering other entrances; and said journal pin being hollow, there being a rod-like stationarily mounted carrier traversing said hollow pin and extending into the manifold chamber, the carrier carrying at one end said cover element, said roll rotating relative to said cover element to obtain thereby progressively the unrestricted access to all of the cooling duct entrances and on a cyclic basis as the roll rotates.

2. The improvement as in claim 1, wherein said rod is hollow serving for the feeding of cooling and being provided with radially outwardly oriented openings for feeding coolant into said chamber.

3. The improvement as in claim 1, wherein said cover element is a disk with a cutout for access to at least one of said duct entrances while covering the others in progressively variant sequence.

4. The improvement as in claim 1, wherein said cover element is constructed to provide variable degree of access to said opening entrances of said cooling ducts.

* * * * *